US010220269B2

(12) United States Patent
Stokke

(10) Patent No.: US 10,220,269 B2
(45) Date of Patent: Mar. 5, 2019

(54) GOLF CLUB HEADS WITH AERODYNAMIC SHAPE AND RELATED METHODS

(71) Applicant: KARSTEN MANUFACTURING CORPORATION, Phoenix, AZ (US)

(72) Inventor: Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/233,696

(22) Filed: Aug. 10, 2016

(65) Prior Publication Data

US 2017/0043223 A1 Feb. 16, 2017

Related U.S. Application Data

(60) Provisional application No. 62/203,756, filed on Aug. 11, 2015.

(51) Int. Cl.
*A63B 53/04* (2015.01)

(52) U.S. Cl.
CPC .. *A63B 53/0466* (2013.01); *A63B 2053/0408* (2013.01); *A63B 2053/0412* (2013.01); *A63B 2225/01* (2013.01)

(58) Field of Classification Search
CPC ..... A63B 53/0466
See application file for complete search history.

(56) References Cited

U.S. PATENT DOCUMENTS 1,514,958 A 11/1924 Dutcher
1,533,638 A 4/1925 Dutcher
5,997,413 A 12/1999 Wood, IV
6,168,537 B1 * 1/2001 Ezawa ..... A63B 53/04 473/327
6,572,489 B2 * 6/2003 Miyamoto ..... A63B 53/0466 473/290
7,252,600 B2 * 8/2007 Murphy ..... A63B 53/02 473/342
7,513,835 B2 * 4/2009 Belmont ..... A63B 53/0466 473/328
8,192,304 B2 6/2012 Rae et al.
8,241,142 B2 * 8/2012 Evans ..... A63B 53/0466 473/345
8,357,058 B2 1/2013 Honea et al.
8,562,455 B2 10/2013 Evans et al.
2015/0005095 A1 1/2015 Ehlers

* cited by examiner

*Primary Examiner* — Michael Dennis

(57) ABSTRACT

Embodiments of golf club heads with aerodynamic shape and related methods are described herein. Various embodiments of the golf club heads with aerodynamic shape and related methods include a golf club head comprising a body. In many embodiments, the body comprises a heel region, a toe region opposite the heel region, a faceplate, a crown, and a sole opposite the crown. In many embodiments, the faceplate comprises a faceplate height measured perpendicularly to a ground plane when the golf club head is at an address position and a faceplate width measured from the heel region to the toe region and in a direction perpendicular to the faceplate height. In some embodiments, the crown comprises an inflection point located at an inflection distance from the faceplate, the inflection distance measured from a center of the faceplate and perpendicularly to the faceplate height. Other examples and related methods are also disclosed herein.

15 Claims, 11 Drawing Sheets

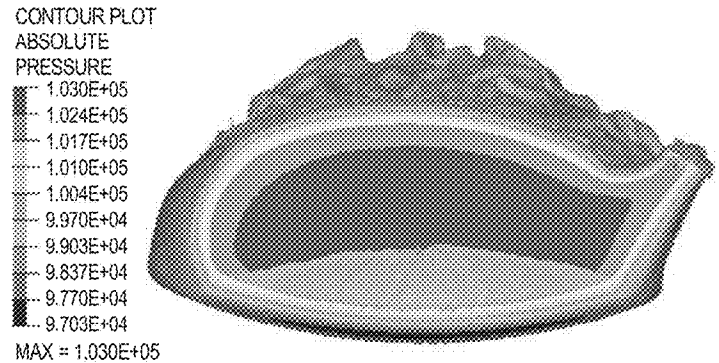
FIG. 10A
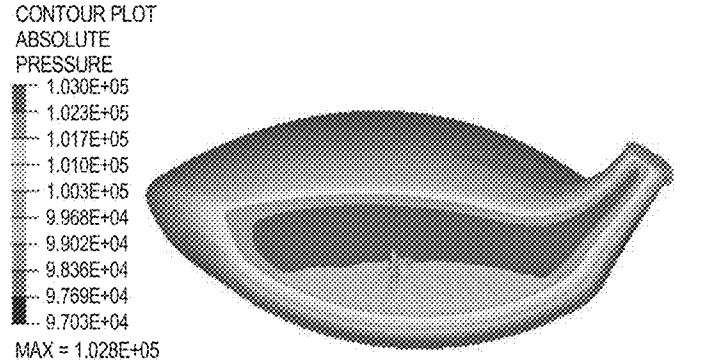
FIG. 10B
FIG. 10C
FIG. 10D

GOLF CLUB HEADS WITH AERODYNAMIC SHAPE AND RELATED METHODS

CROSS REFERENCE TO RELATED APPLICATIONS

This claims the benefit of U.S. Provisional Patent Application No. 62/203,756, filed on Aug. 11, 2015, the contents of which are incorporated fully herein by reference.

TECHNICAL FIELD

This disclosure relates generally to golf clubs, and relates more particularly to golf club heads with aerodynamic shape and related methods.

BACKGROUND

Golf club manufacturers have designed golf club heads with aerodynamic features to improve the flow of air over and around the golf club head. When air flows around a golf club head during a swing of a golf club, a wake, or an area of disturbed air flow, is formed behind the golf club head. In many cases, the wake creates a drag force on the golf club head, thereby slowing the speed of the golf club head throughout the swing. Thus, some golf club heads can be designed to lessen the disturbed air flow during the swing. In many cases, driver golf club heads are designed to maximize the moment of inertia (MOI) of the club head and maintain low and back center of gravity (CG) positions. Increased MOI can result in increased forgiveness for off center impact of a golf ball. Increased MOI can be achieved by maximizing the volume of the club head, and distributing the mass about the perimeter of the club head. Large volume club heads typically result in large club faces. The face of a golf club head is generally the biggest contributor to the drag forces on the club head during a swing. Large club head faces can result in higher drag forces, decreased swing speeds, and shorter ball distance. Therefore, there is a need in the art for a golf club head having a smaller face to reduce aerodynamic drag, while maintaining a high MOI and a low and back CG position.

DETAILED DESCRIPTION

To facilitate further description of the embodiments, the following drawings are provided in which.

Figure 1:
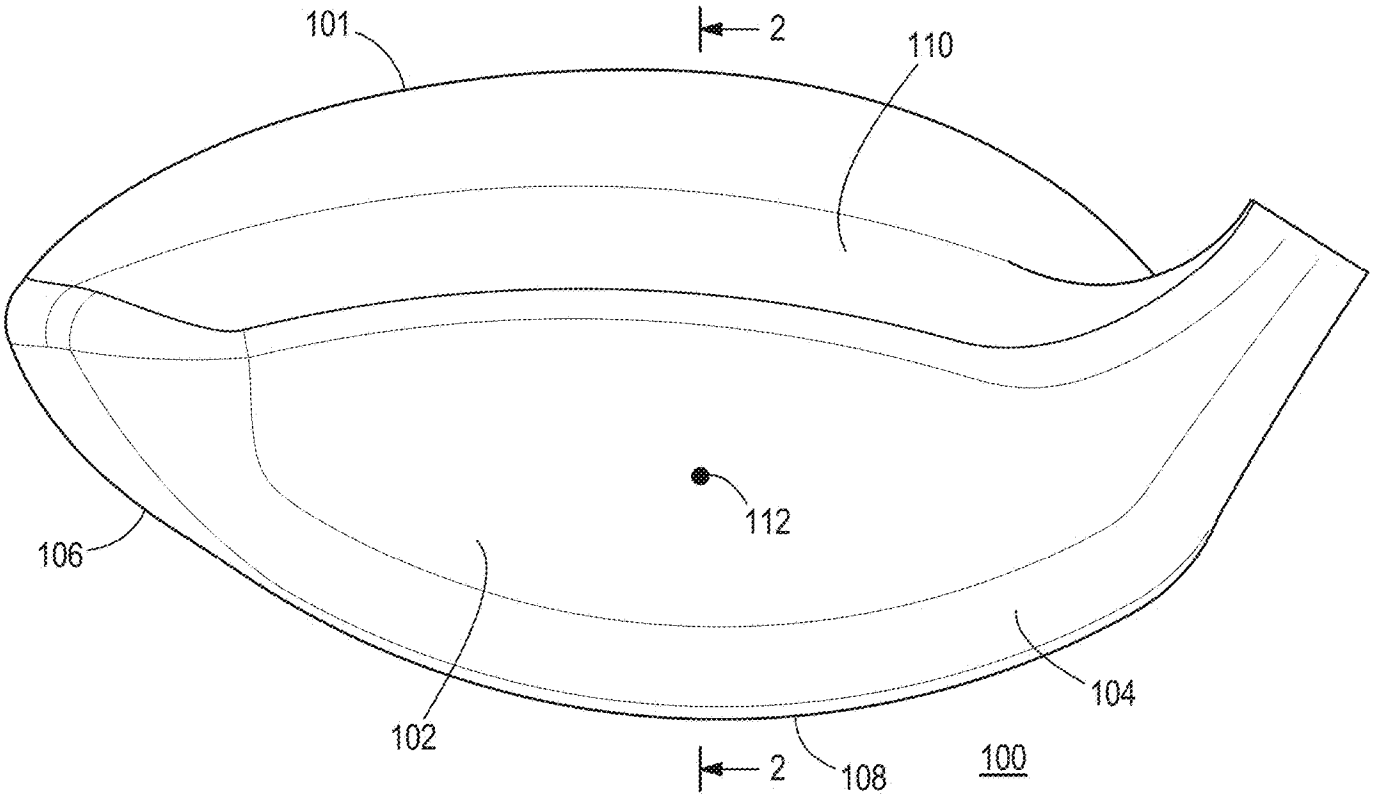
FIG. 1 depicts a front view of a golf club head according to an embodiment.
Figure 4:
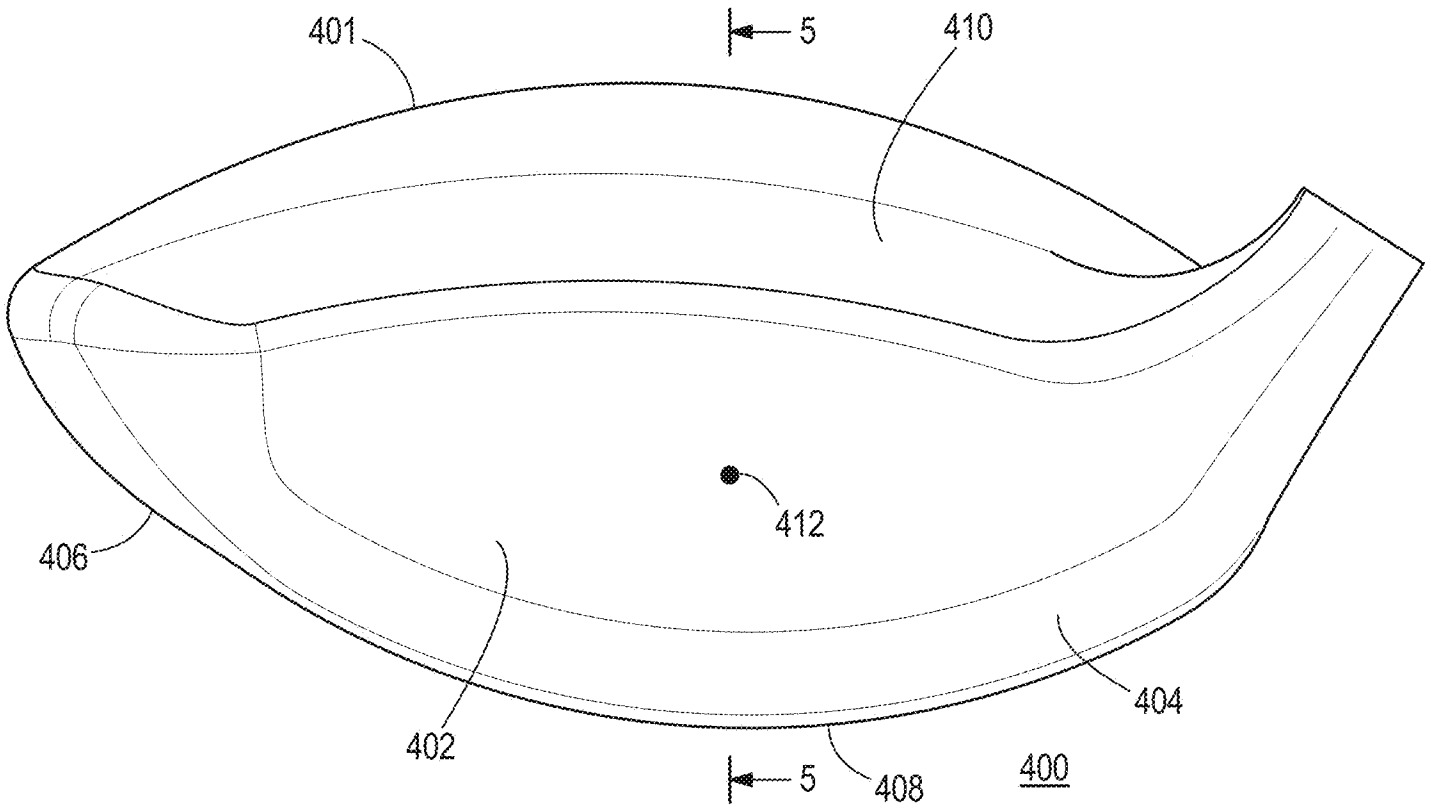
FIG. 4 depicts a front view of a golf club head according to another embodiment.
Figure 7:
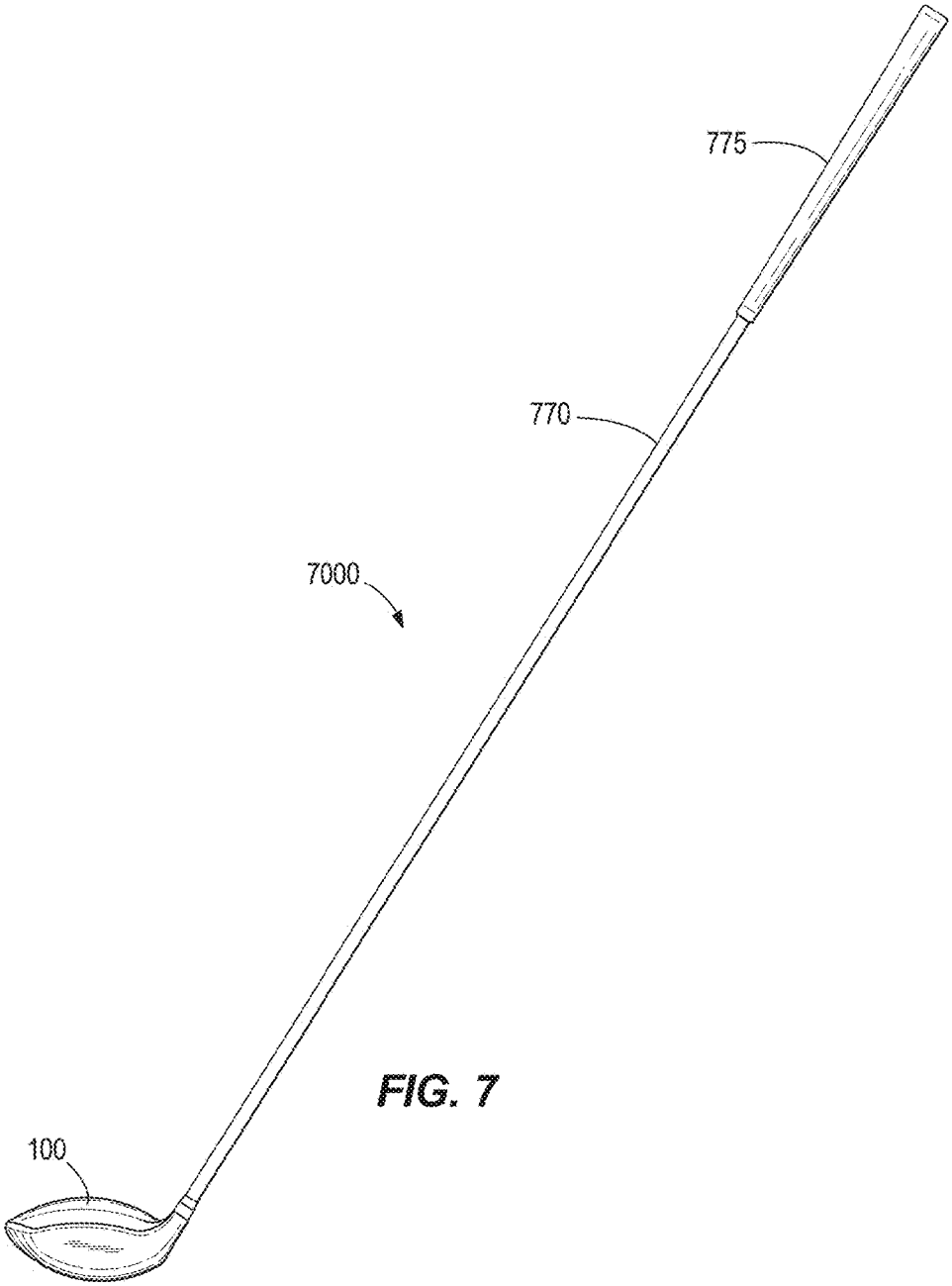
Figure 8A:
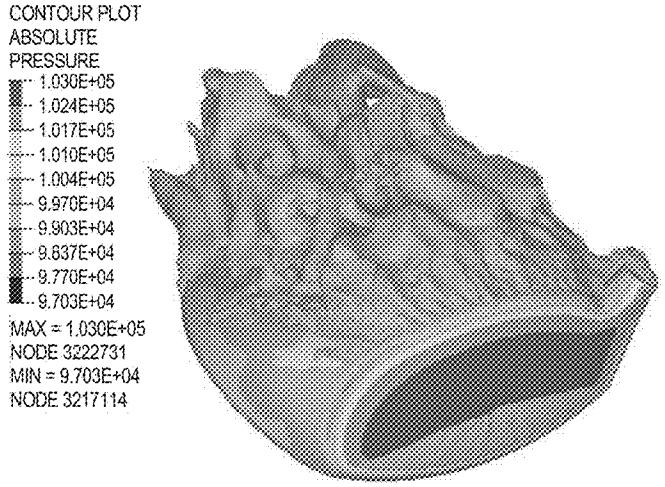
Figure 8B:
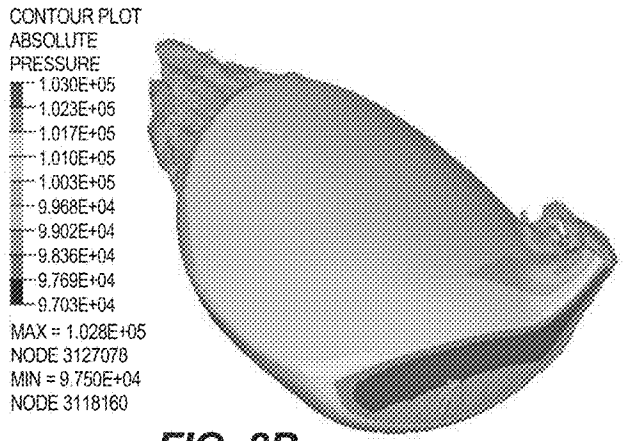
Figure 8C:
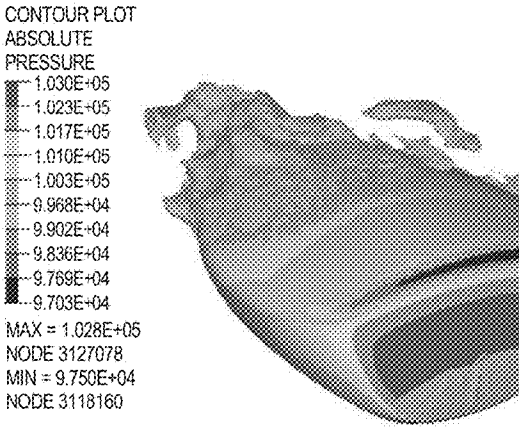
Figure 8D:
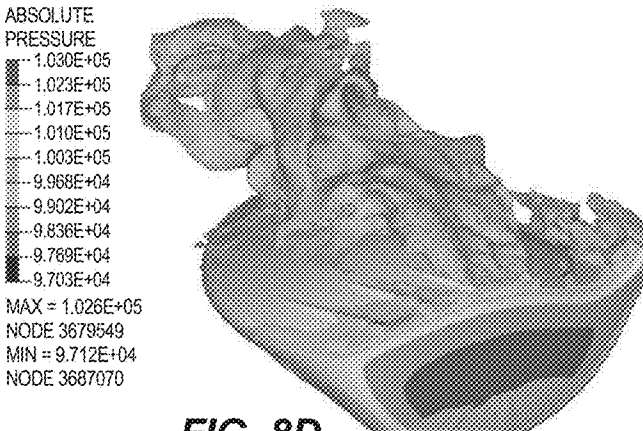
Figure 9A:
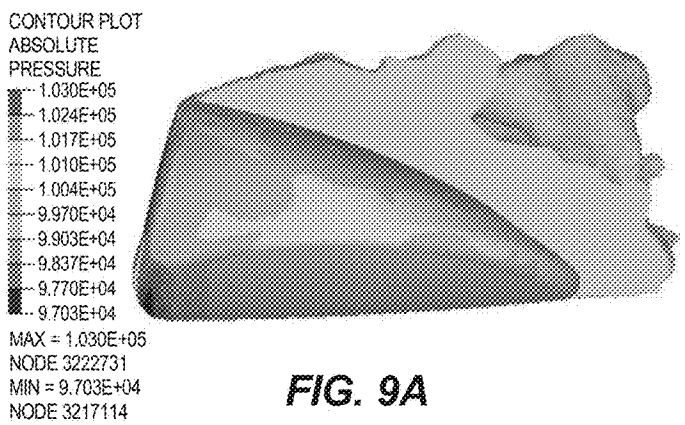
Figure 9B:
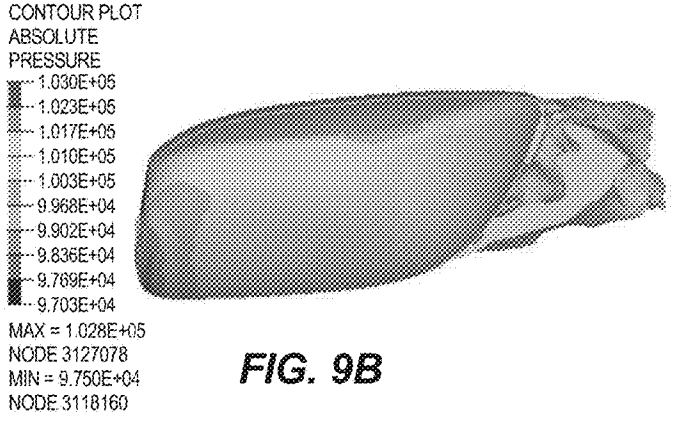
Figure 9C:
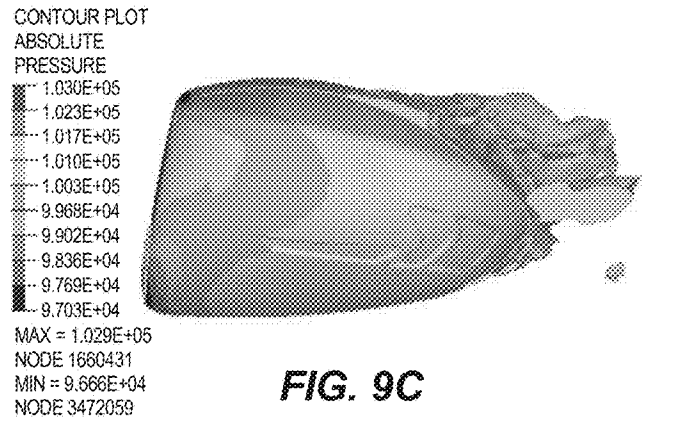
Figure 9D:
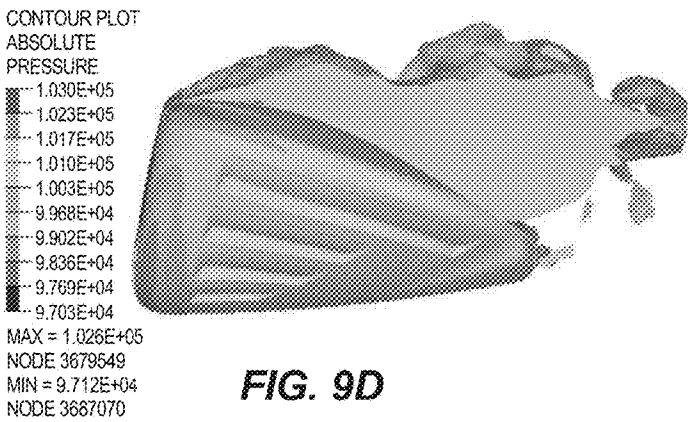
Figure 11A:
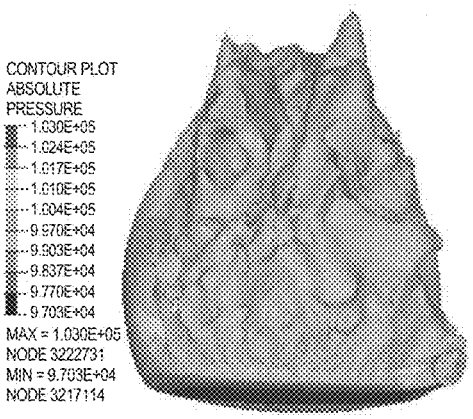
Figure 11B:
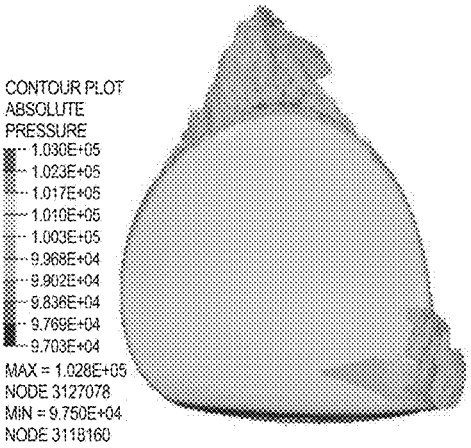
Figure 11C:
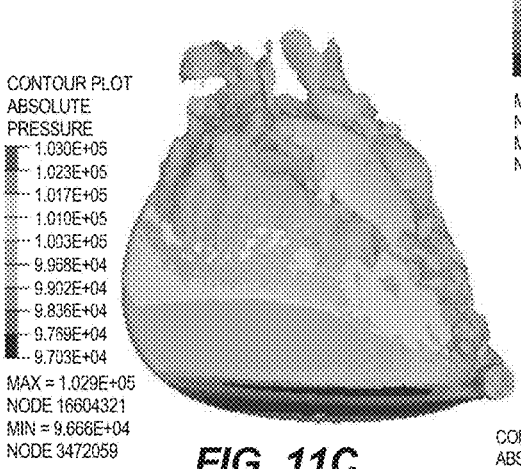
Figure 11D:
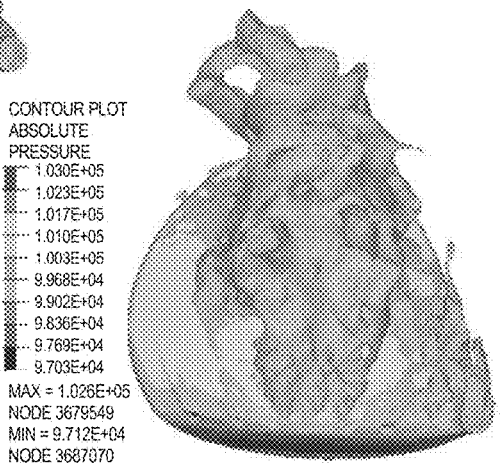
Figure 12:
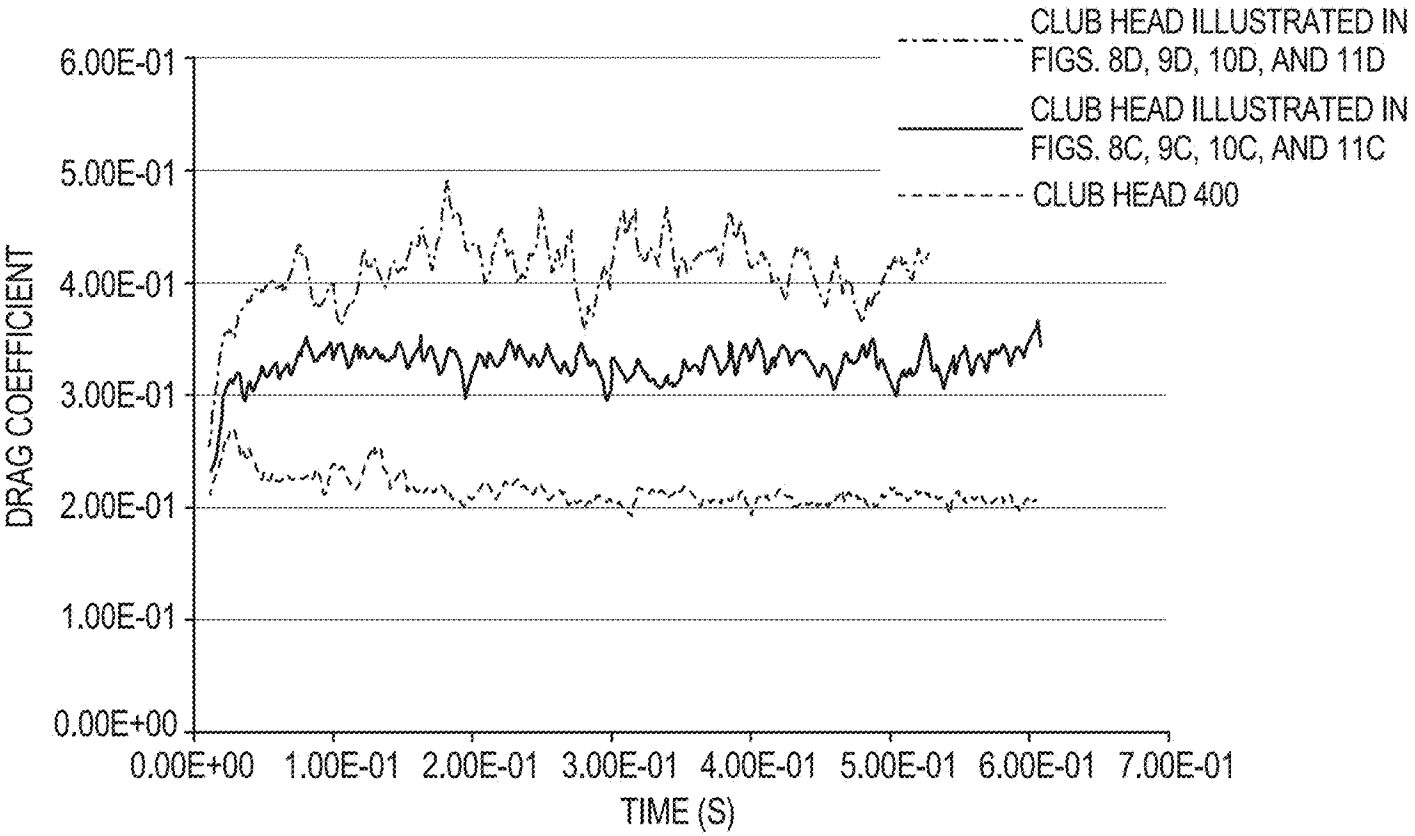
Figure 13:
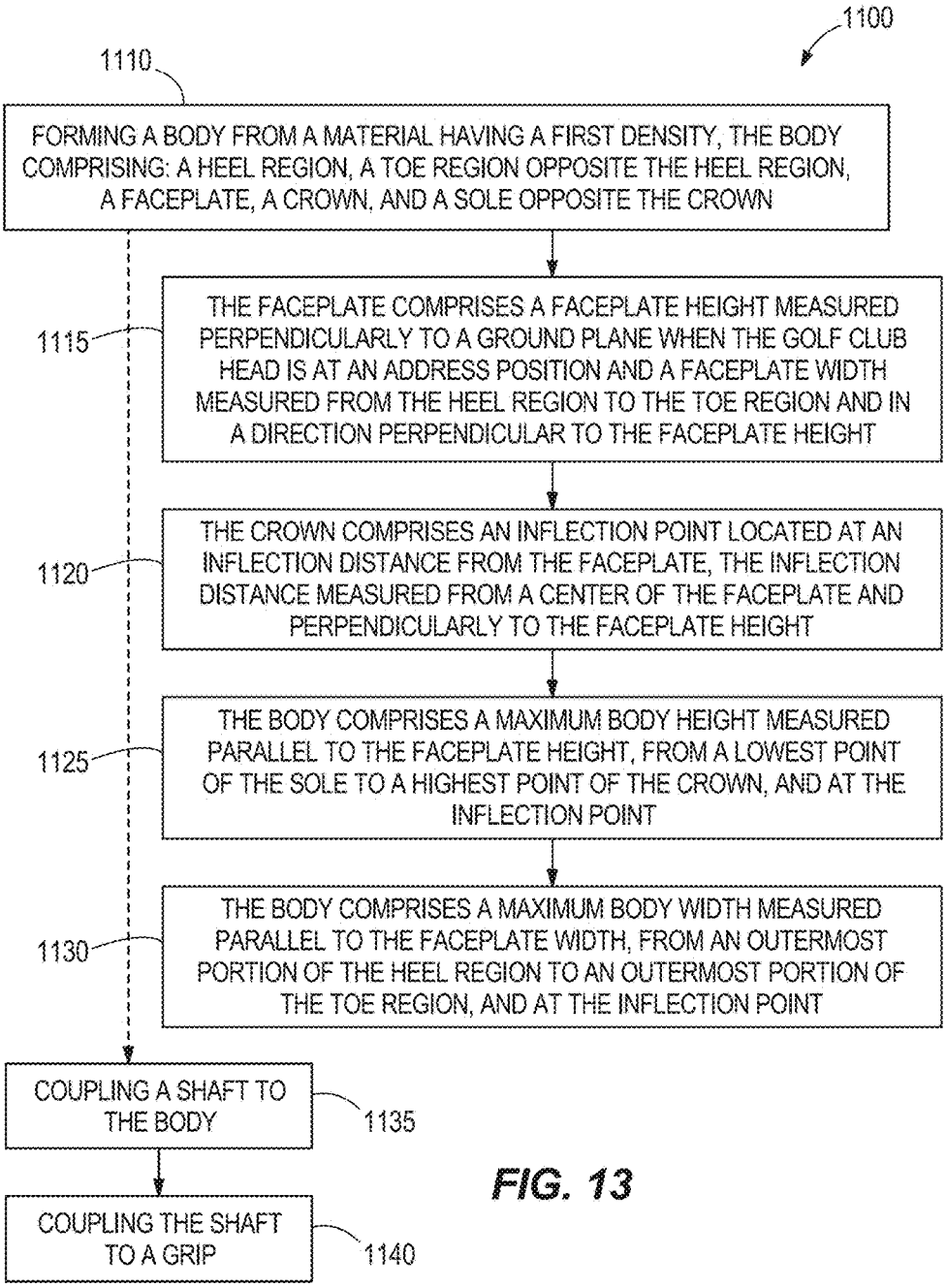

FIG. 7. depicts a golf club comprising the golf club head according to the embodiment of FIG. 1;

FIG. 8A depicts a front perspective view of the aerodynamic drag forces on a typical golf club head;

FIG. 8B depicts a front perspective view of the reduction of aerodynamic drag forces on the club head according to the embodiment of FIG. 4;

FIG. 8C depicts a front perspective view of the aerodynamic drag forces on another typical golf club head;

FIG. 8D depicts a front perspective view of the aerodynamic drag forces on another typical golf club head;

FIG. 9A depicts a side view of the aerodynamic drag forces on the golf club head of FIG. 8A;

FIG. 9B depicts a side view of the reduction of aerodynamic drag forces on the club head according to the embodiment of FIG. 4;

FIG. 9C depicts a side view of the aerodynamic drag forces the golf club head of FIG. 8C;

FIG. 9D depicts a side view of the aerodynamic drag forces the golf club head of FIG. 8D;

FIG. 10A depicts a front view of the aerodynamic drag forces on the golf club head of FIGS. 8A and 9A;

FIG. 10B depicts a front view of the reduction of aerodynamic drag forces on the club head according to the embodiment of FIG. 4;

FIG. 10C depicts a front view of the aerodynamic drag forces on the golf club head of FIGS. 8C and 9C;

FIG. 10D depicts a front view of the aerodynamic drag forces on the golf club head of FIGS. 8D and 9D;

FIG. 11A depicts a top view of the aerodynamic drag forces on the golf club head of FIGS. 8A, 9A, and 10A;

FIG. 11B depicts a top view of the reduction of aerodynamic drag forces on the club head according to the embodiment of FIG. 4;

FIG. 11C depicts a top view of the aerodynamic drag forces on the golf club head of FIGS. 8C, 9C, and 10C;

FIG. 11D depicts a top view of the aerodynamic drag forces on the golf club head of FIGS. 8D, 9D, and 10D;

FIG. 12 depicts the reduced drag coefficient on the golf club head according to the embodiment of FIG. 4, compared to the drag coefficient on the golf club head of FIGS. 8C, 9C, 10C, and 11C and the golf club head of FIGS. 8D, 9D, 10D, and 11D; and FIG. 13 depicts a method of manufacturing a golf club head according to an embodiment.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in a physical, mechanical, or other manner.

DESCRIPTION OF EXAMPLES OF EMBODIMENTS

Various embodiments of the golf club heads with aerodynamic shape and related methods include a golf club head comprising a body. In many embodiments, the body comprises a heel region, a toe region opposite the heel region, a faceplate, a crown, and a sole opposite the crown. In many embodiments, the faceplate comprises a faceplate height measured perpendicularly to a ground plane when the golf club head is at an address position and a faceplate width measured from the heel region to the toe region and in a direction perpendicular to the faceplate height. In some embodiments, the crown comprises an inflection point located at an inflection distance from the faceplate, the inflection distance measured from a center of the faceplate and perpendicularly to a loft plane positioned tangent to a center of the faceplate. In some embodiments, the body comprises a body height measured parallel to the faceplate height, from the sole to a highest point of the crown, and at the inflection point. In many embodiments, the body comprises a body width measured parallel to the faceplate width, from the heel region to the toe region, and at the inflection point. In some embodiments, the body comprises a maximum height measured parallel to faceplate height at the greatest distance from the sole to the crown. In some embodiments, the body comprises a maximum width measured parallel to the faceplate width at the greatest distance from the heel region to the toe region.

Other embodiments of the golf club heads with aerodynamic shape and related methods include a golf club comprising a shaft, a grip, and a golf club head. The golf club head further comprises a body. In many embodiments, the body comprises a heel region, a toe region opposite the heel region, a faceplate, a crown, and a sole opposite the crown. In many embodiments, the faceplate comprises a faceplate height measured perpendicularly to a ground plane when the golf club head is at an address position and a faceplate width measured from the heel region to the toe region and in a direction perpendicular to the faceplate height. In some embodiments, the crown comprises an inflection point located at an inflection distance from the faceplate, the inflection distance measured from a center of the faceplate and perpendicularly to a loft plane positioned tangent to a center of the faceplate. In some embodiments, the body comprises a body height measured parallel to the faceplate height, from the sole to a highest point of the crown, and at the inflection point. In many embodiments, the body comprises a body width measured parallel to the faceplate width, from the heel region to the toe region, and at the inflection point. In some embodiments, the body comprises a maximum height measured parallel to faceplate height at the greatest distance from the sole to the crown. In some embodiments, the body comprises a maximum width measured parallel to the faceplate width at the greatest distance from the heel region to the toe region.

Other embodiments of the golf club heads with aerodynamic shape and related methods include a method for manufacturing a golf club head. The method comprises forming a body from a first material having a first density. In many embodiments, the body comprises a heel region, a toe region opposite the heel region, a faceplate, a crown, and a sole opposite the crown. In many embodiments, the faceplate comprises a faceplate height measured perpendicularly to a ground plane when the golf club head is at an address position and a faceplate width measured from the heel region to the toe region and in a direction perpendicular to the faceplate height. In some embodiments, the crown comprises an inflection point located at an inflection distance from the faceplate, the inflection distance measured from a center of the faceplate and perpendicularly to a loft plane positioned tangent to a center of the faceplate. In some embodiments, the body comprises a body height measured parallel to the faceplate height, from the sole to a highest point of the crown, and at the inflection point. In many embodiments, the body comprises a body width measured parallel to the faceplate width, from the heel region to the toe region, and at the inflection point. In some embodiments, the body comprises a maximum height measured parallel to faceplate height at the greatest distance from the sole to the crown. In some embodiments, the body comprises a maximum width measured parallel to the faceplate width at the greatest distance from the heel region to the toe region.

Turning to the drawings, FIG. 1 illustrates a front view of an embodiment of a golf club head 100. In some embodiments, golf club head 100 can be a driver-type golf club head. In other embodiments, golf club head 100 can be a wood-type, fairway wood, or a hybrid-type golf club head. Golf club head 100 comprises a body 101. In some embodiments, body 101 is molded as a single piece. In many embodiments, body 101 comprises a faceplate 102, a heel region 104, a toe region 106 opposite heel region 104, a sole 108, and a crown 110 opposite sole 108. Faceplate 102 can have a center 112. Faceplate 102 can be formed separately from the rest of body 101 and can be welded or otherwise coupled to body 101. In other embodiments, body 101 can be a unitary piece such that faceplate 102 is formed integrally with the rest of body 101. Generally, club head 100 can comprise any suitable materials, but in many embodiments, club head 100 comprises one or more metal materials. Notwithstanding the foregoing, the apparatus, methods, and articles of manufacture described herein are not limited in this regard.

Figure 5:
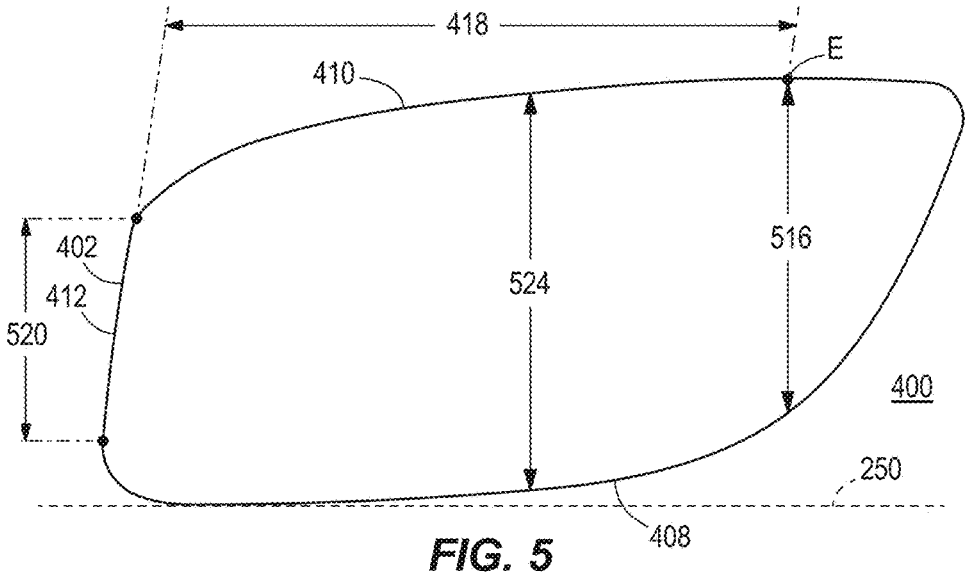
FIG. 5 depicts a side view of a golf club head according to the embodiment of FIG. 4.
Figure 6:
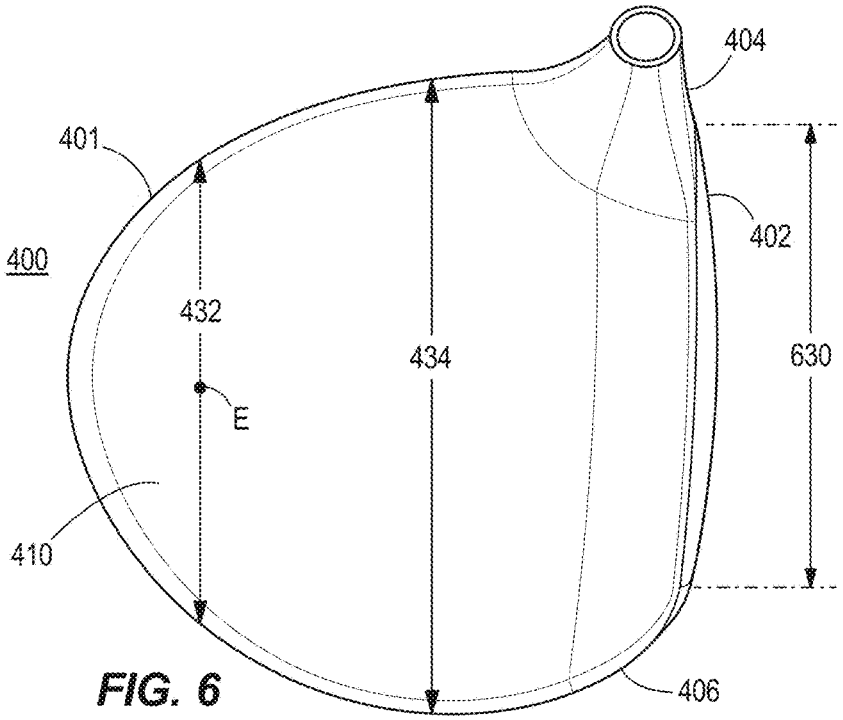
FIG. 6 depicts a top-down view of a golf club head according to the embodiment of FIG. 4.

Golf club head 100 can be part of a corresponding golf club. For example, a golf club 7000 (FIG. 7) can comprise a shaft 770 coupled to golf club head 100 at a first end of shaft 770 and coupled to a grip 775 at a second end of shaft 770. Golf club 700 can comprise any of the golf club head embodiments described herein, including golf club head 100 (FIGS. 1-3) or golf club head 400 (FIGS. 4-6).

Figure 2:
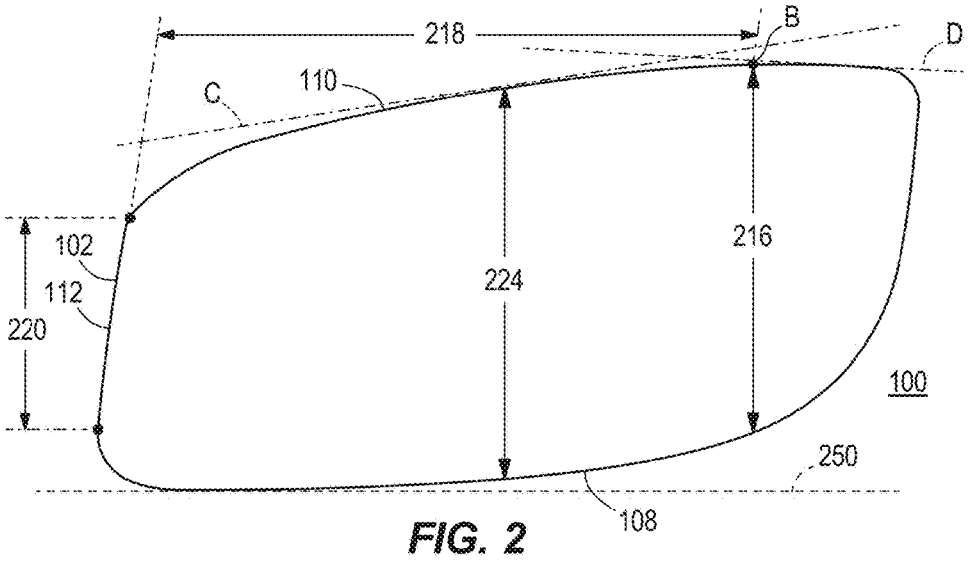
FIG. 2 depicts a cross-sectional view of the golf club head of FIG. 1 along the cross-sectional line 2-2 in FIG. 1.

FIG. 2 illustrates a cross-sectional view of golf club head 100 across the cross-sectional line 2-2 of FIG. 1. Faceplate 102 has a faceplate height 220 measured perpendicularly to a ground plane 250 when golf club head 100 is at an address position. Faceplate height 220 is less than a faceplate height of a faceplate of a typical driver golf club head. In many embodiments, faceplate height 220 can be approximately 2.5 centimeters (cm) to approximately 3.1 cm. In some embodiments, faceplate height 220 can be approximately 2.5 cm, 2.6 cm, 2.7 cm, 2.8, cm, 2.9 cm, 3.0 cm, 3.1 cm. In some embodiments, faceplate height can be approximately 2.949 cm.

Figure 3:
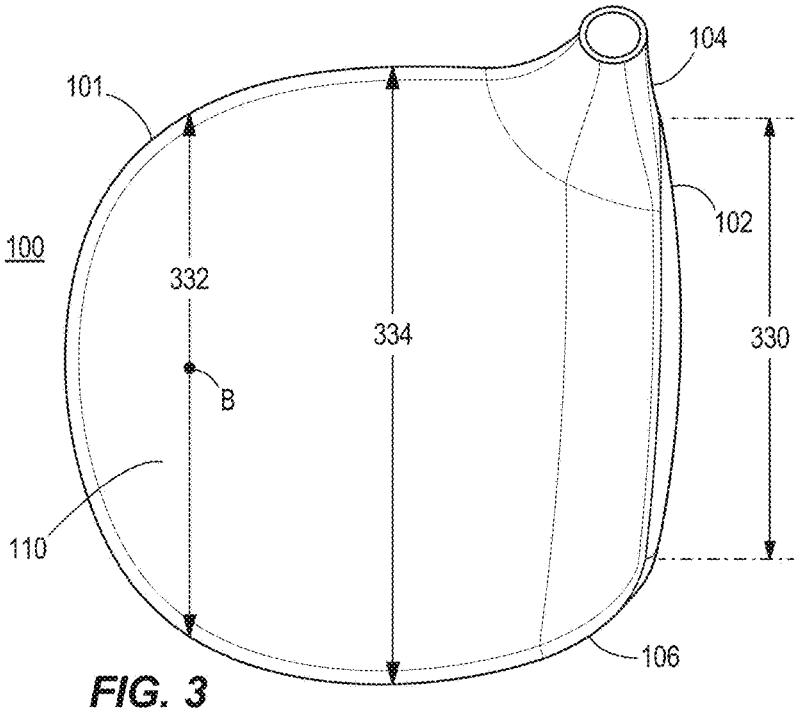
FIG. 3 depicts a top-down view of a golf club head according to the embodiment of FIG. 1.

In some embodiments, crown 110 comprises a single inflection point B. Inflection point B is located at an inflection distance 218 from the faceplate 102, the inflection distance 218 measured from a center of the faceplate 102 and perpendicularly to a loft plane 120 positioned tangent to the center of the faceplate. The inflection point is a point on the external curve of crown 110 at which the sign of the curvature changes. As explained later, body 101 can have a body height 216 at single inflection point B. The surface of body 101 can transition somewhat linearly between the reference points for faceplate height 220, body height 216, and/or inflection distance 218, or the surface may transition with a curved profile between these points. Similarly, the surface of body 101 can transition somewhat linearly or with a curved profile through the reference points for strikeface width 330 (FIG. 3), and/or body width 332 (FIG. 3). In many embodiments, the surface area of the transition of the surface of body 101 can be larger than the surface area of the transition of the surface of the body of the typical driver golf club head. In many embodiments, the smaller area of faceplate 102 and larger transition surfaces result in decreased pressure drag on golf club head 100. This decreased pressure can result in increased swing speed and greater ball distance.

From an origin of inflection point B on a x-y coordinate system, it can be seen that a line C tangent to crown 110 and located at a point between inflection point B and strikeface 102, has a negative slope. While a line D tangent to crown 110, and located at a point between a back of golf club head 100 and inflection point B, has a positive slope. The single inflection point characteristic for crown 110 can be limited to the rear part of crown 110 and can exclude any features located in front of the inflection point and toward strikeface 102, and such features can be excluded even if they extend from the front part of crown 110 to the rear part of crown 110. Such features can include the turbulators taught by U.S. Pat. No. 8,608,587, entitled "Golf Club Heads with Turbulators and Methods to Manufacture Golf Club Heads with Turbulators," which is herein incorporated by reference.

In many embodiments, inflection point B can be located at an inflection distance 218 from faceplate 102. Inflection distance 218 is measured from center 112 of faceplate 102 and perpendicularly to loft plane 120. In many embodiments, inflection distance 218 can be approximately 9.5 cm to 10 cm. In some embodiments, inflection distance 218 can be approximately 9.5 cm, 9.6 cm, 9.7 cm, 9.8 cm, 9.9 cm, or 10 cm. In some embodiments, inflection distance 218 can be approximately 9.764 cm.

In many embodiments, inflection distance 218 can comprise greater than 50%, greater than 55%, greater than 60%, greater than 65%, greater than 70%, greater than 75%, greater than 80%, greater than 85%, or greater than 90% of the length of the club head 100. In some embodiments, the inflection distance 218 can comprise approximately 60-100%, approximately 70-100%, approximately 80-100%, or approximately 90-100% of the length of the club head 100. For example, in some embodiments, the inflection distance can comprise approximately 65%, 70%, 75%, 80%, 85%, 90%, or 95% of the length of the club head 100. In these or other embodiments, the length of the club head 100 can be measured as the greatest perpendicular distance from the loft plane to a rear end of the club head 100.

FIG. 3 illustrates a top-down view of golf club head 100. Faceplate 102 has a faceplate width 330 measured from heel region 104 to toe region 106 and in a direction perpendicular to faceplate height 220 (FIG. 2). In many embodiments, faceplate width 330 can be approximately 8.5 cm to 9 cm. In some embodiments, faceplate width 330 can be approximately 8.5 cm, 8.6 cm, 8.7 cm, 8.8 cm, 8.9 cm, or 9 cm. In some embodiments, faceplate width 330 can be approximately 8.75 cm.

Faceplate 102 of golf club head 100 has an area that is smaller than a typical driver golf club head. In some embodiments, the area of faceplate 102 can be similar in size to a typical 3 wood golf club head. In many embodiments, the area of faceplate 102 can be approximately 20 $cm^2$ to approximately 24 $cm^2$. In some embodiments, the area of faceplates 102 can be approximately 20 $cm^2$, 21 $cm^2$, 22 $cm^2$, 23 $cm^2$, or 24 $cm^2$. In some embodiments, the area of faceplate 102 can be approximately 22.155 $cm^2$. In many embodiments, the smaller club face can result in decreased pressure from drag forces exerted on golf club head 100 during a swing. Golf club 100 can experience less drag than the typical driver type club head due in part to a reduced face area.

In some embodiments, a projected area of the silhouette of golf club head 100 can be approximately 50 $cm^2$ to approximately 60 $cm^2$. In some embodiments, the projected area of the silhouette of golf club head 100 can be approximate 50 $cm^2$, 51 $cm^2$, 52 $cm^2$, 53 $cm^2$, 54 $cm^2$, 55 $cm^2$, 56 $cm^2$, 57 $cm^2$, 58 $cm^2$, 59 $cm^2$, or 60 $cm^2$. In many embodiments, the projected area of the silhouette of golf club head 100 can be approximately 56.9 $cm^2$.

In some embodiments, a back of body 101 of golf club head 100 can be increased to achieve a large golf club head volume. Golf club head 100 can have a high moment of inertia (MOI) similar to the typical driver golf club head by maintaining a large club head volume. In addition to maintain a high MOI, in many embodiments, golf club head 100 has a center of gravity (CG) that is located low and in the back center of body 101, similar to the typical driver golf club head. In some embodiments, golf club head 100 comprises perimeter weighting similar to the typical driver golf club head.

In many embodiments, golf club head 100 comprises a volume of approximately 360 cubic centimeters (cc) to approximately 460 cc. In some embodiments, the volume of golf club head 100 is approximately 460 cc. In many embodiments, the back of body 101 of golf club head 100 can be larger than the typical driver golf club head. Returning to FIG. 2, body 101 can comprise a body height 216 measured parallel to faceplate height 220, from the sole to a highest point of the crown, and at inflection point B. Body height 216 can be similar to or greater than a body height of a typical driver golf club head. In many embodiments, body height 216 can be approximately 4.2 cm to 5.2 cm. In some embodiments, body height 216 can be 4.2 cm, 4.3 cm, 4.4 cm, 4.5 cm, 4.6 cm, 4.7 cm, 4.8 cm, 4.9 cm, 5.0 cm, 5.1 cm, or 5.2 cm. In some embodiments, body height 216 can be approximately 4.648 cm.

Returning to FIG. 3, body 101 has a body width 332 measured parallel to faceplate width 330, from heel region 104 to toe region 106, and at inflection point B. In a typical driver golf club head, body width 332 is located near the faceplate of the golf club head. In some embodiments, body width 332 is located farther from faceplate 102 and closer to the back of golf club head 100. Body width 332 can be similar to or greater than a body width of a typical driver golf club head. In many embodiments, body width 332 can be approximately 8.2 cm to 9 cm. In some embodiments, body width 332 can be approximately 8.2 cm, 8.3 cm, 8.4 cm, 8.5 cm, 8.6 cm, 8.7 cm, 8.8 cm, 8.9 cm, or 9 cm. In some embodiments, body width 332 can be approximately 8.547 cm.

Returning to FIG. 2, as described above, in many embodiments faceplate height 220 is less than the faceplate height of a faceplate of a typical driver golf club head, and body height 216 is similar to or greater than the body height of a typical driver golf club head. Therefore, in many embodiments, a first ratio for golf club head 100, as defined by body height 216 to faceplate height 220, can be greater than a first ratio of a typical driver golf club head. In many embodiments, the first ratio for golf club head 100 can be approximately 1.4 to 1.7, while the first ratio of the typical driver golf club head is approximately 1.35. In many embodiments, the first ratio for golf club head 100 can be approximately 1.4, 1.5, 1.6, or 1.7. In some embodiments, the first ratio for golf club head 100 can be approximately 1.58.

A second ratio for golf club head 100 can be defined by inflection distance 218 to body height 216. In many embodiments, the second ratio for golf club head 100 can be greater than a second ratio of a typical driver golf club head. In many embodiments, the second ratio for golf club head 100 can be approximately 0.5 to approximately 3.0, while the second ratio of the typical driver golf club head is approximately 0.35. In some embodiments, the second ratio for golf club head 100 can be approximately 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, or 3.0.

Returning to FIG. 3, a third ratio for golf club head 100 can be defined by body width 332 to faceplate width 330. In many embodiments, faceplate width 330 can be less than the faceplate width of a typical driver golf club head, and body width 332 can be similar to or greater than the body width of the typical driver golf club head. Therefore, in many embodiments, the third ratio for golf club head 100 can be less than a third ratio of a typical driver golf club head. In many embodiments, the third ratio for golf club head 100 can be approximately 0.8 to 1.2, while the third ratio of the typical driver golf club head is approximately 1.37. In some embodiments, the third ratio for golf club head 100 can be approximately 0.8, 0.9, 1.0, 1.1, or 1.2. In some embodiments, the third ratio for golf club head 100 can be approximately 0.98.

Considering FIGS. 2 and 3, a fourth ratio for golf club head 100 can be defined by inflection distance 218 to body width 332. In many embodiments, the fourth ratio for golf club head 100 can be greater than a fourth ratio of a typical driver golf club head. In many embodiments, the fourth ratio for golf club head 100 can be approximately 0.3 to 1.3, while the fourth ratio of the typical driver golf club head is approximately 0.18. In some embodiments, the fourth ratio for golf club head 100 can be approximately 0.3, 0.4, 0.5, 0.6, 0.7, 0.8, 0.9, 1.0, 1.1, 1.2, or 1.3. In some embodiments, the fourth ratio for golf club head 100 can be approximately 1.14.

A fifth ratio can be defined by a volume of golf club head 100 to an area of faceplate 102. In many embodiments, the fifth ratio for golf club head 100 can be greater than a fifth ratio of a typical driver golf club head. In many embodiments, the fifth ratio for golf club head 100 can be approximately 100 to 150, while the fifth ratio of the typical driver golf club head is approximately 75. In some embodiments, the fifth ratio for golf club head 100 can be approximately 100, 105, 110, 115, 120, 125, 130, 135, 140, 145, or 150. In some embodiments, the fifth ratio for golf club head 100 can be approximately 134.

Similarly, a sixth ratio for golf club head 100 can be defined by a volume of the golf club head to a projected area of the silhouette of golf club head 100, and can be greater than that of typical driver golf club heads described in the art. In some embodiments, the sixth ratio for golf club head 100 can be approximately 48 to approximately 56, while the sixth ratio of the typical driver golf club head can be approximately 45.5. In some embodiments, the sixth ratio for golf club head 100 can be approximately 48, 49, 50, 51, 52, 53, 54, 55, or 56.

Returning to FIGS. 2 and 3, body 101 may further comprise a maximum height 224 measured parallel to faceplate height 220 at the greatest distance from the sole 108 to the crown 110. In many embodiments, the maximum height 224 for golf club head 100 can be greater than a maximum height of a typical driver golf club head. In some embodiments, the maximum height 224 aligns with body height 216. In some embodiments, the maximum height 224 may be closer to the faceplate 102 or farther from the faceplate 102 than body height 216.

Returning to FIGS. 2 and 3, body 101 may further comprise a maximum width 334 measured parallel to the faceplate width 330 at the greatest distance from the heel region 104 to the toe region 106. In some embodiments, the maximum width 334 aligns with body width 332. In some embodiments, the maximum width 334 may be closer to the faceplate 102 or farther from the faceplate 102 than body width 332. In many embodiments, the maximum width 334 for golf club head 100 can be greater than a maximum width of a typical driver golf club head.

The maximum height 224 and the maximum width 334 may provide the same or different ratios (i.e. first ratio, second ratio, third ratio, fourth ratio, fifth ratio or sixth ratio), as described above, when maximum height 224 and maximum width 334 are used in place of body height 216 and body width 332, respectively. Further, the ratios determined using maximum height 224 and maximum width 334 in place of body height 216 and body width 332, respectively, may provide the same or different trends when compared to a typical driver golf club head.

FIG. 4 illustrates a front view of golf club head 400. Golf club head 400 is similar to golf club head 100 (FIG. 1). FIG. 5 illustrates a cross-sectional view of golf club 400 across cross-sectional line 5-5. FIG. 6 illustrates a top down view of golf club head 400.

Discussing FIGS. 4-6 together, in some embodiments, golf club head 400 can be a driver-type golf club head. In other embodiments, golf club head 400 can be a wood-type, fairway wood, or a hybrid-type golf club head. Golf club head 400 comprises a body 401. In some embodiments, body 401 is molded as a single piece. In many embodiments, body 401 comprises a faceplate 402, a heel region 404, a toe region 406 opposite heel region 404, a sole 408, and a crown 410 opposite sole 408.

Similar to faceplate 102, faceplate 402 is smaller than the faceplate of the typical driver golf club head. Golf club head 400 can maintain a large overall volume of approximately 360 cc to 460 cc.

In some embodiments, crown 410 comprises a single inflection point E (FIG. 5). In many embodiments, inflection point E can be similar to inflection point B (FIG. 2). Faceplate 402 has a faceplate height 520 measured perpendicularly to a ground plane 250 when golf club head 400 is at an address position. Faceplate 402 has a faceplate width 630 (FIG. 6) measured from heel region 404 to toe region 406 and in a direction perpendicular to faceplate height 520 (FIG. 5). Inflection point E is located at an inflection distance 418 from the faceplate 402, the inflection distance 418 measured from a center of the faceplate 402 and perpendicularly to the loft plane 120. Inflection distance 418 can be similar to inflection distance 218. Body 401 can comprise a body height 516 (FIG. 5) measured parallel to faceplate height 520, from the sole to a highest point of the crown, and at inflection point E. Body 401 has a body width 432 (FIG. 6) measured parallel to faceplate width 630, from heel region 404 to toe region 406, and at inflection point E.

In many embodiments, body height 516 (FIG. 5) can be less than body height 216 (FIG. 2) and/or less than the body height of the typical driver golf club head. In many embodiments, body width 432 (FIG. 6) can be less than body width 332 (FIG. 3). In many embodiments, body width 432 (FIG. 6) can be less than approximately 8.2 cm. The reduced dimensions of body height 516 (FIG. 5) and body width 432 (FIG. 6) compared to body height 216 (FIG. 2) and body width 332 (FIG. 3) result in a more egg-shaped profile that still maintains a small area of the faceplate and a large ratio of volume to area of the faceplate. In some embodiments, maximum height 524 (FIG. 5) and maximum width 434 (FIG. 6) can be greater than maximum height 224 (FIG. 2) and maximum width 334 (FIG. 3), respectively, to achieve the egg-shaped profile. In this embodiment, golf club head 400 still experiences less drag than the typical driver type club head due to the reduced face area and body shape. Golf club head 400 also maintains a high MOI by maintaining a large club head volume. However, by reducing the dimensions body height 516 (FIG. 5) and body width 432 (FIG. 6), golf club head 400 can achieve a lower and farther back CG position. Therefore, golf club head 400 can maintain desired performance characteristics associated with high MOI and low and back CG placement, while reducing aerodynamic drag to increase swing speeds and ball distance.

FIGS. 8-11 illustrate the reduced drag on golf club head 400 (FIGS. 4-6) compared to typical golf club heads using computational fluid dynamics. Golf club head 400 is represented in FIGS. 8B, 9B, 10B, and 11B. The remaining golf club heads in FIGS. 8-11 (i.e. FIGS. 8A, 8C, 8D, 9A, 9C, 9D, 10A, 10C, 10D, 11A, 11C, and 11D) represent typical golf club heads. For example, FIGS. 8A, 9A, 10A, and 11A illustrate a typical golf club head having a greater faceplate height and a greater faceplate area than the height and area of faceplate 402 of golf club head 400, respectively. Further, the typical golf club head illustrated in FIGS. 8A, 9A, 10A, and 11A has an inflection distance less than approximately 2.5 cm (i.e. less than the inflection distance 418 of golf club head 400). For further example, FIGS. 8C, 8D, 9C, 9D, 10C, and 10D illustrate typical golf club heads having a greater faceplate height and a greater faceplate area than the height and area of faceplate 402 of golf club head 400, respectively. Further, the typical golf club heads illustrated in FIGS. 8C, 8D, 9C, 9D, 10C, and 10D have an inflection distance less than approximately 7.5 cm (i.e. less than the inflection distance 418 of golf club head 400).

Further referring to FIGS. 8-11, the golf club head 400 (FIGS. 8B, 9B, 10B, and 11B) has reduced flow separation on the crown, and reduced pressure on the faceplate during a swing (due to the reduced faceplate height and surface area), resulting in reduced drag coefficient on the club head 400 compared to typical golf club heads.

FIG. 12 graphically illustrates the reduced drag coefficient of golf club head 400 compared to the typical golf club head illustrated in FIGS. 8C, 9C, 10C, and 11C, and the typical golf club head illustrated in FIGS. 9D, 9D, 10D, and 11D, according to the computational fluid dynamic simulations visually illustrated in FIGS. 8-11.

From FIGS. 8-12, it can be seen that the flow separation is greater on the crown of the typical golf club heads, and the flow separation is reduced on golf club head 400. In FIGS. 8-11, the air flow separates closer to the faceplate on the typical driver golf club heads and stays attached to the body of the typical driver golf club heads for a longer length over the crown. This early separation causes an increase in turbulence over the crown of the typical driver golf club heads, thereby increasing drag on the typical driver golf club heads. The smaller area of faceplate 402 on golf club head 400 and the longer transition of body 401 (the longer inflection distance 418) provide a more streamlined golf club head, which results in a delay in flow separation and a decrease in pressure or drag forces on crown 408. Golf club head 100 (FIGS. 1-3) has similar advantages to golf club head 400 (FIGS. 4-6).

Returning to FIGS. 5 and 6, body 401 may further comprise a maximum height 524 measured parallel to faceplate height 520 at the greatest distance from the sole 408 to the crown 410. In some embodiments, the maximum height 524 aligns with body height 516. In some embodiments, the maximum height 524 may be closer to the faceplate 402 or farther from the faceplate 402 than body height 516. In many embodiments, the maximum height 524 for golf club head 400 can be greater than a maximum height of a typical driver golf club head.

Returning to FIGS. 5 and 6, body 401 may further comprise a maximum width 434 measured parallel to the faceplate width 630 at the greatest distance from the heel region 404 to the toe region 406. In some embodiments, the maximum width 434 aligns with body width 432. In some embodiments, the maximum width 434 may be closer to the faceplate 402 or farther from the faceplate 402 than body width 432. In many embodiments, the maximum width 434 for golf club head 400 can be greater than a maximum width of a typical driver golf club head.

The maximum height 524 and the maximum width 434 may provide the same or different ratios (i.e. first ratio, second ratio, third ratio, fourth ratio, fifth ratio or sixth ratio), as described above, when maximum height 524 and maximum width 434 are used in place of body height 516 and body width 432, respectively. Further, the ratios determined using maximum height 524 and maximum width 434 in place of body height 516 and body width 432, respectively, may provide the same or different trends when compared to a typical driver golf club head.

Some embodiments, such as the one shown in FIG. 13, include a method 1100 for manufacturing a golf club head (e.g., golf club head 100). In some embodiments, method 1100 comprises forming a body from a material having a first density (block 1110). In many embodiments the body can comprise a heel region, a toe region opposite the heel region, a faceplate, a crown, and a sole opposite the crown. In some embodiments, the faceplate comprises a faceplate height measured perpendicularly to a ground plane when the golf club head is at an address position and a faceplate width measured from the heel region to the toe region and in a direction perpendicular to the faceplate height (block 1115). In many embodiments, the crown can comprise an inflection point located at an inflection distance from the faceplate, the inflection distance measured from a center of the faceplate and perpendicularly to the loft plane (block 1120). In many embodiments, the body comprises a body height measured parallel to the faceplate height, from the sole to a highest point of the crown, and at the inflection point (block 1125) and the body comprises a body width measured parallel to the faceplate width, from the heel region to the toe region, and at the inflection point (block 1130). Method 1100 can further comprise coupling a shaft to the body (block 1135) and coupling the shaft to a grip (block 1140). The sequence of blocks 1135 and 1140 can be reversed.

The golf club heads with aerodynamic shapes and related methods discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of systems and methods for fitting golf club head weight, and may disclose alternative embodiments of golf club heads with cavities and related methods.

Clause 1: A golf club head comprising a body comprising a heel region; a toe region opposite the heel region; a faceplate comprising a faceplate height measured perpendicularly to a ground plane when the golf club head is at an address position and a faceplate width measured from the heel region to the toe region and in a direction perpendicular to the faceplate height; a crown comprising an inflection point located at an inflection distance from the faceplate, the inflection distance measured from a center of the faceplate and perpendicularly to a loft plane positioned tangent to a center of the faceplate, the inflection distance comprising greater than 50% of a length of the club head, the length of the club head measured as the greatest perpendicular distance from the loft plane to a rear end of the club head, and a sole opposite the crown, wherein the body comprises a body height measured parallel to the faceplate height, from the sole to a highest point of the crown, and at the inflection point, and the body comprises a body width measured parallel to the faceplate width, from the heel region to the toe region, and at the inflection point.

Clause 2: The golf club head of clause 1, wherein the faceplate height is approximately 2.5 cm to 3.1 cm.

Clause 3: The golf club head of clause 1, wherein the faceplate height is approximately 2.949 cm.

Clause 4: The golf club head of clause 1, wherein the faceplate width is approximately 8.5 cm to 9 cm.

Clause 5: The golf club head of clause 1, wherein the faceplate width is approximately 8.75 cm.

Clause 6: The golf club head of clause 1, wherein the inflection distance is approximately 9.5 cm to 10 cm.

Clause 7: The golf club head of clause 1, wherein the inflection distance is approximately 9.764 cm.

Clause 8: The golf club head of clause 1, wherein an area of the faceplate is approximately 20 $cm^2$ to 24 $cm^2$.

Clause 9: The golf club head of clause 1, wherein an area of the faceplate is approximately 22.155 $cm^2$.

Clause 10: The golf club head of clause 1, wherein a volume of the club head is approximately 360 cc to 460 cc.

Clause 11: The golf club head of clause 1, wherein a first ratio of the body height to the faceplate height is approximately 1.4 to approximately 1.7.

Clause 12: The golf club head of clause 1, wherein a first ratio of the body height to the faceplate height is approximately 1.58.

Clause 13: The golf club head of clause 1, wherein a second ratio of the inflection distance to the body height is approximately 0.5 to approximately 3.0.

Clause 14: The golf club head of clause 1, wherein a second ratio of the inflection distance to the body height is approximately 2.10.

Clause 15: The golf club head of clause 1, wherein a third ratio of the body width to the faceplate width is approximately 0.8 to approximately 1.2.

Clause 16: The golf club head of clause 1, wherein a third ratio of the body width to the faceplate width is approximately 0.98.

Clause 17: The golf club head of clause 1, wherein a fourth ratio of the inflection distance to the body width is approximately 0.3 to approximately 1.3.

Clause 18: The golf club head of clause 1, wherein a fourth ratio of the inflection distance to the body width is approximately 1.14.

Clause 19: The golf club head of clause 1, wherein a fifth ratio of a volume of the club head to an area of the faceplate is approximately 100 to 150.

Clause 20: The golf club head of clause 1, wherein a fifth ratio of a volume of the club head to an area of the faceplate is approximately 134.

Clause 21: A golf club comprising a body comprising a heel region; a toe region opposite the heel region; a faceplate comprising a faceplate height measured perpendicularly to a ground plane when the golf club head is at an address position, and a faceplate width measured from the heel region to the toe region and in a direction perpendicular to the faceplate height; a crown comprising an inflection point located at an inflection distance from the faceplate, the inflection distance measured from a center of the faceplate and perpendicularly to a loft plane positioned tangent to a center of the faceplate, the inflection distance comprising greater than 50% of a length of the club head, the length of the club head measured as the greatest perpendicular distance from the loft plane to a rear end of the club head; and a sole opposite the crown, a shaft having a first end coupled to the body, and a grip coupled to a second end of the shaft wherein the body comprises a body height measured parallel to the faceplate height, from the sole to a highest point of the crown, and at the inflection point and the body comprises a body width measured parallel to the faceplate width, from the heel region to the toe region, and at the inflection point.

Clause 22: The golf club head of clause 21, wherein the faceplate height is approximately 2.5 cm to 3.1 cm.

Clause 23: The golf club head of clause 21, wherein the faceplate height is approximately 2.949 cm.

Clause 24: The golf club head of clause 21, wherein the faceplate width is approximately 8.5 cm to 9 cm.

Clause 25: The golf club head of clause 21, wherein the faceplate width is approximately 8.75 cm.

Clause 26: The golf club head of clause 21, wherein the inflection distance is approximately 9.5 cm to 10 cm.

Clause 27: The golf club head of clause 21, wherein the inflection distance is approximately 9.764 cm.

Clause 28: The golf club head of clause 21, wherein an area of the faceplate is approximately 20 $cm^2$ to 24 $cm^2$.

Clause 29: The golf club head of clause 21, wherein an area of the faceplate is approximately 22.155 $cm^2$.

Clause 30: The golf club head of clause 21, wherein a volume of the club head is approximately 360 cc to 460 cc.

Clause 31: The golf club head of clause 21, wherein a first ratio of the body height to the faceplate height is approximately 1.4 to approximately 1.7.

Clause 32: The golf club head of clause 21, wherein a first ratio of the body height to the faceplate height is approximately 1.58.

Clause 33: The golf club head of clause 21, wherein a second ratio of the inflection distance to the body height is approximately 0.5 to approximately 3.0.

Clause 34: The golf club head of clause 21, wherein a second ratio of the inflection distance to the body height is approximately 2.10.

Clause 35: The golf club head of clause 21, wherein a third ratio of the body width to the faceplate width is approximately 0.8 to approximately 1.2.

Clause 36: The golf club head of clause 21, wherein a third ratio of the body width to the faceplate width is approximately 0.98.

Clause 37: The golf club head of clause 21, wherein a fourth ratio of the inflection distance to the body width is approximately 0.3 to approximately 1.3.

Clause 38: The golf club head of clause 21, wherein a fourth ratio of the inflection distance to the body width is approximately 1.14.

Clause 39: The golf club head of clause 21, wherein a fifth ratio of a volume of the club head to an area of the faceplate is approximately 100 to approximately 150.

Clause 40: The golf club head of clause 21, wherein a fifth ratio of a volume of the club head to an area of the faceplate is approximately 134.

Clause 41: A method for manufacturing a golf club head, the method comprising forming a body from a material having a first density, the body comprising a heel region; a toe region opposite the heel region; a faceplate comprising a faceplate height measured perpendicularly to a ground plane when the golf club head is at an address position and a faceplate width measured from the heel region to the toe region and in a direction perpendicular to the faceplate height; a crown comprising an inflection point located at an inflection distance from the faceplate, the inflection distance measured from a center of the faceplate and perpendicularly to a loft plane positioned tangent to a center of the faceplate and a sole opposite the crown, the inflection distance comprising greater than 50% of a length of the club head, the length of the club head measured as the greatest perpendicular distance from the loft plane to a rear end of the club head, wherein the body comprises a body height measured parallel to the faceplate height, from the sole to a highest point of the crown, and at the inflection point, and the body comprises a body width measured parallel to the faceplate width, from the heel region to the toe region, and at the inflection point.

Clause 42: The golf club head of clause 41, wherein the faceplate height is approximately 2.5 cm to 3.1 cm.

Clause 43: The golf club head of clause 41, wherein the faceplate height is approximately 2.949 cm.

Clause 44: The golf club head of clause 41, wherein the faceplate width is approximately 8.5 cm to 9 cm.

Clause 45: The golf club head of clause 41, wherein the faceplate width is approximately 8.75 cm.

Clause 46: The golf club head of clause 41, wherein the inflection distance is approximately 9.5 cm to 10 cm.

Clause 47: The golf club head of clause 41, wherein the inflection distance is approximately 9.764 cm.

Clause 48: The golf club head of clause 41, wherein an area of the faceplate is approximately 20 $cm^2$ to 24 $cm^2$.

Clause 49: The golf club head of clause 41, wherein an area of the faceplate is approximately 22.155 $cm^2$.

Clause 50: The golf club head of clause 41, wherein a volume of the club head is approximately 360 cc to 460 cc.

Clause 51: The golf club head of clause 41, wherein a first ratio of the body height to the faceplate height is approximately 1.4 to approximately 1.7.

Clause 52: The golf club head of clause 41, wherein a first ratio of the body height to the faceplate height is approximately 1.58.

Clause 53: The golf club head of clause 41, wherein a second ratio of the inflection distance to the body height is approximately 0.5 to approximately 3.0.

Clause 54: The golf club head of clause 41, wherein a second ratio of the inflection distance to the body height is approximately 2.10.

Clause 55: The golf club head of clause 41, wherein a third ratio of the body width to the faceplate width is approximately 0.8 to approximately 1.2.

Clause 56: The golf club head of clause 41, wherein a third ratio of the body width to the faceplate width is approximately 0.98.

Clause 57: The golf club head of clause 41, wherein a fourth ratio of the inflection distance to the body width is approximately 0.3 to approximately 1.3.

Clause 58: The golf club head of clause 41, wherein a fourth ratio of the inflection distance to the body width is approximately 1.14.

Clause 59: The golf club head of clause 41, wherein a fifth ratio of a volume of the club head to an area of the faceplate is approximately 100 to approximately 150.

Clause 60: The golf club head of clause 41, wherein a fifth ratio of a volume of the club head to an area of the faceplate is approximately 134.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:

a body comprising:

a heel region;

a toe region opposite the heel region;

a faceplate comprising:

a faceplate height measured perpendicularly to a ground plane when the golf club head is at an address position; and a faceplate width measured from the heel region to the toe region and in a direction perpendicular to the faceplate height;

a crown comprising:

an inflection point having a surface tangent that is parallel to the ground plane when the golf club head is at the address position, the surface tangent existing within a cross-sectional plane that extends through the faceplate and is perpendicular to the faceplate width;

wherein the inflection point is located an inflection distance from the faceplate, the inflection distance measured perpendicularly to a loft plane positioned tangent to a center of the faceplate; and wherein the inflection distance is greater than 50% of a length of the club head, the length of the club head measured as the greatest perpendicular distance from the loft plane to a rear end of the club head;

a sole opposite the crown;

a body height measured parallel to the faceplate height, from the sole to a highest point of the crown, and at the inflection point;

a body width measured parallel to the faceplate width, from the heel region to the toe region, and at the inflection point; and wherein:

the body height is approximately 4.2 cm to 5.2 cm;

the body width is less than 8.2 cm;

the face plate height is approximately 2.5 cm to 3.1 cm;

a first ratio of the body height to the faceplate height is approximately 1.4 to approximately 1.7; and a volume of the club head is approximately 360 cc to 460 cc.

2. The golf club head of claim 1, wherein:

the faceplate width is approximately 8.5 cm to 9 cm.

3. The golf club head of claim 1, wherein:

an area of the faceplate is approximately 20 $cm^2$ to 24 $cm^2$.

4. The golf club head of claim 1, wherein:

a second ratio of the inflection distance to the body height is approximately 0.5 to approximately 3.0.

5. The golf club head of claim 1, wherein:

a third ratio of the body width to the faceplate width is approximately 0.8 to approximately 1.2.

6. The golf club head of claim 1, wherein:

a fourth ratio of the inflection distance to the body width is approximately 0.3 to approximately 1.3.

7. The golf club head of claim 1, wherein:

a fifth ratio of a volume of the club head to an area of the faceplate is approximately 100 to approximately 150.

8. A golf club comprising:

a body comprising:

a heel region;

a toe region opposite the heel region;

a faceplate comprising:

a faceplate height measured perpendicularly to a ground plane when the golf club head is at an address position; and a faceplate width measured from the heel region to the toe region and in a direction perpendicular to the faceplate height;

a crown comprising:

an inflection point located at an inflection distance from the faceplate, the inflection distance measured perpendicularly to a loft plane positioned tangent to a center of the faceplate, the inflection distance comprising greater than 50% of a length of the club head, the length of the club head measured as the greatest perpendicular distance from the loft plane to a rear end of the club head;

a sole opposite the crown;

a shaft having a first end coupled to the body; and a grip coupled to a second end of the shaft;

wherein:

the body comprises a body height measured parallel to the faceplate height, from the sole to a highest point of the crown, and at the inflection point; and the body comprises a body width measured parallel to the faceplate width, from the heel region to the toe region, and at the inflection point;

the body height is approximately 4.2 cm to 5.2 cm;

the body width is less than 8.2 cm;

a ratio of the body height to the faceplate height is approximately 1.4 to approximately 1.7; and a volume of the club head is approximately 360 cc to 460 cc.

9. The golf club of claim 8, wherein:

the faceplate height is approximately 2.5 cm to 3.1 cm.

10. The golf club of claim 8, wherein:

the faceplate width is approximately 8.5 cm to 9 cm.

11. The golf club of claim 8, wherein:

an area of the faceplate is approximately 20 $cm^2$ to 24 $cm^2$.

12. The golf club of claim 8, wherein:

a second ratio of the inflection distance to the body height is approximately 0.5 to approximately 3.0.

13. The golf club of claim 8, wherein:

a third ratio of the body width to the faceplate width is approximately 0.8 to approximately 1.2.

14. The golf club of claim 8, wherein:

a fourth ratio of the inflection distance to the body width is approximately 0.3 to approximately 1.3.

15. The golf club of claim 8, wherein:

a fifth ratio of a volume of the club head to an area of the faceplate is approximately 100 to approximately 150.

* * * * *